US010501836B2

(12) United States Patent
Yokoyama et al.

(10) Patent No.: US 10,501,836 B2
(45) Date of Patent: Dec. 10, 2019

(54) METHODS OF MAKING BULK METALLIC GLASS FROM POWDER AND FOILS

(71) Applicant: Apple Inc., Cupertino, CA (US)

(72) Inventors: Yoshihiko Yokoyama, Tokyo (JP); Theodore A. Waniuk, Lake Forest, CA (US); Naoto Matsuyuki, Kasugai (JP)

(73) Assignee: Apple Inc., Cupertino, CA (US)

( * ) Notice: Subject to any disclaimer, the term of this patent is extended or adjusted under 35 U.S.C. 154(b) by 308 days.

(21) Appl. No.: 15/493,633

(22) Filed: Apr. 21, 2017

(65) Prior Publication Data

US 2018/0080109 A1 Mar. 22, 2018

Related U.S. Application Data

(60) Provisional application No. 62/397,415, filed on Sep. 21, 2016.

(51) Int. Cl.

| | |
|---|---|
| ***H05B 6/64*** | (2006.01) |
| ***C22F 1/18*** | (2006.01) |
| ***C22C 45/10*** | (2006.01) |
| ***C22C 1/00*** | (2006.01) |

(52) U.S. Cl.

CPC ..... *C22F 1/186* (2013.01); *C22C 1/002* (2013.01); *C22C 45/10* (2013.01); *C22C 2200/02* (2013.01); *C22C 2200/04* (2013.01)

(58) Field of Classification Search

CPC ..... C22F 1/186; C22C 1/002; C22C 45/10; C22C 2200/02; C22C 2200/04; H05B 3/0004; H05B 3/023; H05B 6/64

USPC ..... 148/527

See application file for complete search history.

(56) References Cited

U.S. PATENT DOCUMENTS

| | | | | |
|---|---|---|---|---|
| 8,231,948 | B2 * | 7/2012 | Sawyer | B81C 99/0085 428/34.1 |
| 8,613,813 | B2 | 12/2013 | Johnson et al. | |
| 8,613,814 | B2 | 12/2013 | Kaltenboeck et al. | |
| 8,613,815 | B2 | 12/2013 | Johnson et al. | |
| 8,613,816 | B2 | 12/2013 | Kaltenboeck et al. | |
| 2009/0162629 | A1 * | 6/2009 | Demetriou | C03C 3/32 428/220 |
| 2012/0103478 | A1 * | 5/2012 | Johnson | B21D 22/022 148/561 |
| 2012/0255338 | A1 * | 10/2012 | Johnson | B21C 37/02 72/342.1 |

(Continued)

*Primary Examiner* — Patricia L. Hailey
(74) *Attorney, Agent, or Firm* — Polsinelli PC

(57) ABSTRACT

Methods of forming a bulk metallic glass disclosed. The methods include packing a metallic glass-forming alloy powder to form a green body; heating the green body to a temperature between the glass transition temperature and the melting point of the metallic glass-forming alloy to form a heated green body; and cooling the heated green body to a temperature below the glass transition temperature of the metallic glass-forming alloy to form the bulk metallic glass. The methods of forming a bulk metallic glass also include packing one or more layers of an amorphous foil to form a green body; heating the green body to a temperature between the glass transition temperature and the melting point of the metallic glass-forming alloy to form a heated green body; and cooling the heated green body to a temperature below the glass transition temperature of the metallic glass-forming alloy to form the bulk metallic glass.

20 Claims, 6 Drawing Sheets

(56) References Cited

U.S. PATENT DOCUMENTS

| | | | | |
|---|---|---|---|---|
| 2014/0283956 | A1* | 9/2014 | Schramm | C21D 1/40<br>148/511 |
| 2014/0342179 | A1* | 11/2014 | Hofmann | C22C 45/10<br>428/613 |
| 2017/0203358 | A1* | 7/2017 | Schramm | B21J 1/006 |

* cited by examiner

METHODS OF MAKING BULK METALLIC GLASS FROM POWDER AND FOILS

CROSS-REFERENCE TO RELATED PATENT APPLICATION

This patent application claims the benefit of U.S. patent application Ser. No. 62/397,415, entitled "METHODS OF MAKING A BULK METALLIC GLASSES FROM POWDERS AND FOILS" filed on Sep. 21, 2016 under 35 U.S.C. § 119(e), which is incorporated herein by reference in its entirety.

FIELD

The disclosure is directed to methods of making a bulk metallic glass from metallic glass-forming alloys. Additionally, the methods of the disclosure can be used to form bulk metallic glasses from alloys that are marginal glass-formers or bulk glass-formers.

BACKGROUND

Metallic glasses have properties such as high corrosion resistance, high strength, and high toughness. However, some metallic glass-forming alloys have limited glass-forming ability, which can present a challenge in forming bulk metallic glass objects or parts (e.g., objects or parts larger than 1 mm).

The largest thickness that a metallic glass can be formed from a given alloy composition is linked to the cooling rate required to bypass the formation of the stable crystalline phase. The lower this "critical" cooling rate is, the larger the "critical" thickness of the metallic glass. The empirical relationship linking the critical cooling rate Rc in K/s and the critical thickness tc in mm is given by:

$$Rc=1000/tc^2 \quad \text{Eq. (1)}$$

Generally, three categories are known in the art for identifying the ability of a metal alloy to form a metallic glass (i.e. to bypass the stable crystal phase and form an amorphous phase). Metal alloys having critical cooling rates in excess of $10^{12}$ K/s are conventionally referred to as non-glass-formers, as they are physically unattainable to achieve such cooling rates for a bulk thickness. Metal alloys having critical cooling rates in the range of $10^5$ to $10^{12}$ K/s are conventionally referred to as marginal glass-formers, as they are able to form glass over thicknesses ranging from 1 to 100 micrometers according to Eq. (1). Metal alloys having critical cooling rates on the order of $10^3$ or less, and as low as 1 or 0.1 K/s, are conventionally referred to as bulk glass-formers, as they are able to form glass over thicknesses ranging from a millimeter to several centimeters.

Bulk metallic glass parts are often manufactured from alloy compositions that are considered bulk glass-formers. In various manufacturing processes, a feedstock sample formed of a bulk amorphous glass forming alloy can be heated and molded into a bulk object or part. However, alloy compositions that are conventionally considered bulk amorphous glass-formers are limited. Further, various manufacturing processes generally require that metallic glass-forming alloy feedstock be a monolithic sample.

BRIEF SUMMARY

The disclosure provides methods of making bulk metallic glasses from metallic glass-forming alloys in the form of powder or foils. The metallic glass-forming alloys can be marginal glass-formers or bulk glass-formers. By using a rapid heating technique, such as a rapid capacitor discharge forming (RCDF) technique, amorphous powder, nanocrystal powder coated with an amorphous material, amorphous powder, or amorphous foils can be formed into a composite article or an amorphous article.

In some aspects, the methods include forming a bulk metallic glass from a metallic glass-forming alloy. The methods include packing a metallic glass-forming alloy powder to form a green body; heating the green body to a temperature between the glass transition temperature and the melting point of the metallic glass-forming alloy to form a heated green body; and cooling the heated green body to a temperature below the glass transition temperature of the metallic glass-forming alloy to form the bulk metallic glass.

In other aspects, the methods of forming a bulk metallic glass include packing one or more layers of an amorphous foil to form a green body. The green body is heated to a temperature between the glass transition temperature and the melting point of the metallic glass-forming alloy to form a heated green body. The heated green body is then cooled to a temperature below the glass transition temperature of the metallic glass-forming alloy to form the bulk metallic glass.

In other aspects, a bulk metallic glass can be produced from a metallic glass-forming alloy. A metallic glass-forming alloy powder is packed to form a green body. The green body is heated to a temperature between the glass transition temperature and the melting point of the metallic glass-forming alloy to form a heated green body. The heated green body is cooled to a temperature below the glass transition temperature of the metallic glass-forming alloy to form the bulk metallic glass.

Additional embodiments and features are set forth in part in the description that follows, and will become apparent to those skilled in the art upon examination of the specification or may be learned by the practice of the disclosed subject matter. A further understanding of the nature and advantages of the present disclosure may be realized by reference to the remaining portions of the specification and the drawings, which forms a part of this disclosure.

BRIEF DESCRIPTION OF THE DRAWINGS

The description will be more fully understood with reference to the following figures and data graphs, which are presented as various embodiments of the disclosure and should not be construed as a complete recitation of the scope of the disclosure, wherein.

DETAILED DESCRIPTION

The disclosure may be understood by reference to the following detailed description, taken in conjunction with the drawings as described below. It is noted that, for purposes of illustrative clarity, certain elements in various drawings may not be drawn to scale.

The disclosure provides methods for forming a bulk metallic glass from metallic glass-forming alloy powder. The powder can be formed, for example, into a shaped article. The metallic glass-forming alloy powder can be mechanically packed to form a green body. The green body is then heated to a temperature between the glass transition temperature and the melting point of the metallic glass-forming alloy to form a heated green body. The heated green body is cooled to a temperature below the glass transition of the metallic glass-forming alloy. The rapid heating technique includes a rapid capacitor discharge forming (RCDF) technique, microwave heating technique, pulse Joule heating technique, and the like.

The disclosure also provides methods for forming BMGs from metallic glass-forming alloys in the form of foils into a bulk metallic glass article. The foils can be mechanically packed (e.g., rolled, stacked, etc.) to form a green body. After rapidly heating the green body to a temperature between the glass transition temperature and the melt point of the metallic glass-forming alloy, the heated green body is cooled to a temperature below the glass transition of the metallic glass-forming alloy. The methods disclosed herein thereby allow formation of bulk metallic glass parts without requiring monolithic bulk metallic glass feedstocks. Further, metallic glass forming alloys can be alloys that are marginal glass formers, or can incorporate additional elements.

Metallic glasses can be made at lower material cost. Generally, production of bulk metallic glasses by RCDF is very expensive due to the high material cost of the bulk metallic glasses. Furthermore, the monolithic bulk metallic glass feedstocks of metallic glass-forming alloys for use in RCDF are very expensive due to a limited number of suppliers. The material cost can be significantly reduced by the disclosed methods.

Figure 1:
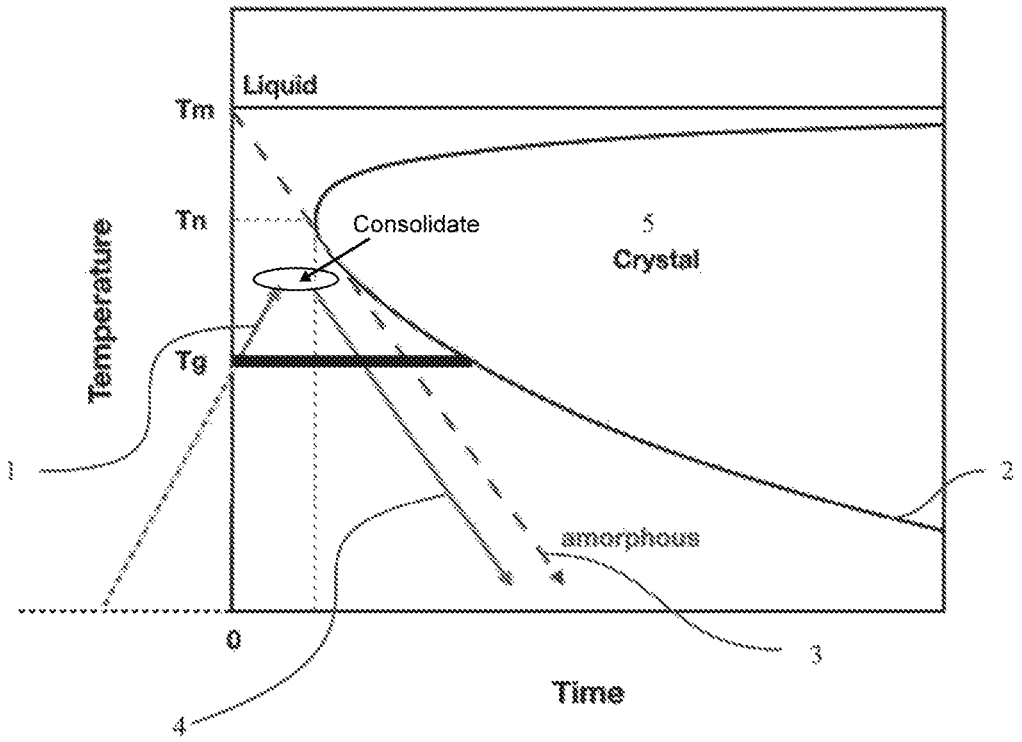
FIG. 1 shows a schematic illustration of a time-temperature-transition (TTT) curve for a metallic glass-forming alloy and a time-temperature (TT) curve for methods of making a bulk metallic glass in accordance with embodiments of the disclosure.

FIG. 1 illustrates a time-temperature profile showing an exemplary embodiment of methods of the embodiment and a time-temperature-transformation (TTT) cooling curve of an exemplary metallic glass-forming alloy. The cooling rate of the molten metal to form a bulk metallic glass part has to be such that the time-temperature profile during cooling does not traverse through the nose-shaped region bounding the crystallized region in the TTT diagram of FIG. 1. In FIG. 1, $T_{nose}$ is referred to as the critical crystallization temperature Tx where crystallization is most rapid and occurs in the shortest time scale. If the cooling of the melt is not fast enough, for example, within boundary 2, crystal 5 may be formed such that a metallic glass-forming alloy may include a mixture of an amorphous phase and a crystalline phase. Accordingly, as shown, along path 1, a green body can be rapidly heated to a temperature between the glass transition temperature and the melting point, and then cooled along path 4, to form a bulk metallic glass part or a bulk composite part.

Using an understanding of the TTT curve, methods for the formation of bulk metallic glass parts from powder and foils have been developed and are described in this disclosure. In some embodiments, the powder may include particles in an amorphous phase (referred to here as amorphous powder). In other embodiments, the powder may include particles that are in a crystalline phase. In such embodiments, the crystalline phase includes particles of nanocrystals and the powder is referred to here as nanocrystal powder. To aid in forming the nanocrystal powder into a bulk metallic glass part, the particles of nanocrystals can be coated with an amorphous material. Coating of the particles will be discussed in more detail below.

Figure 2:
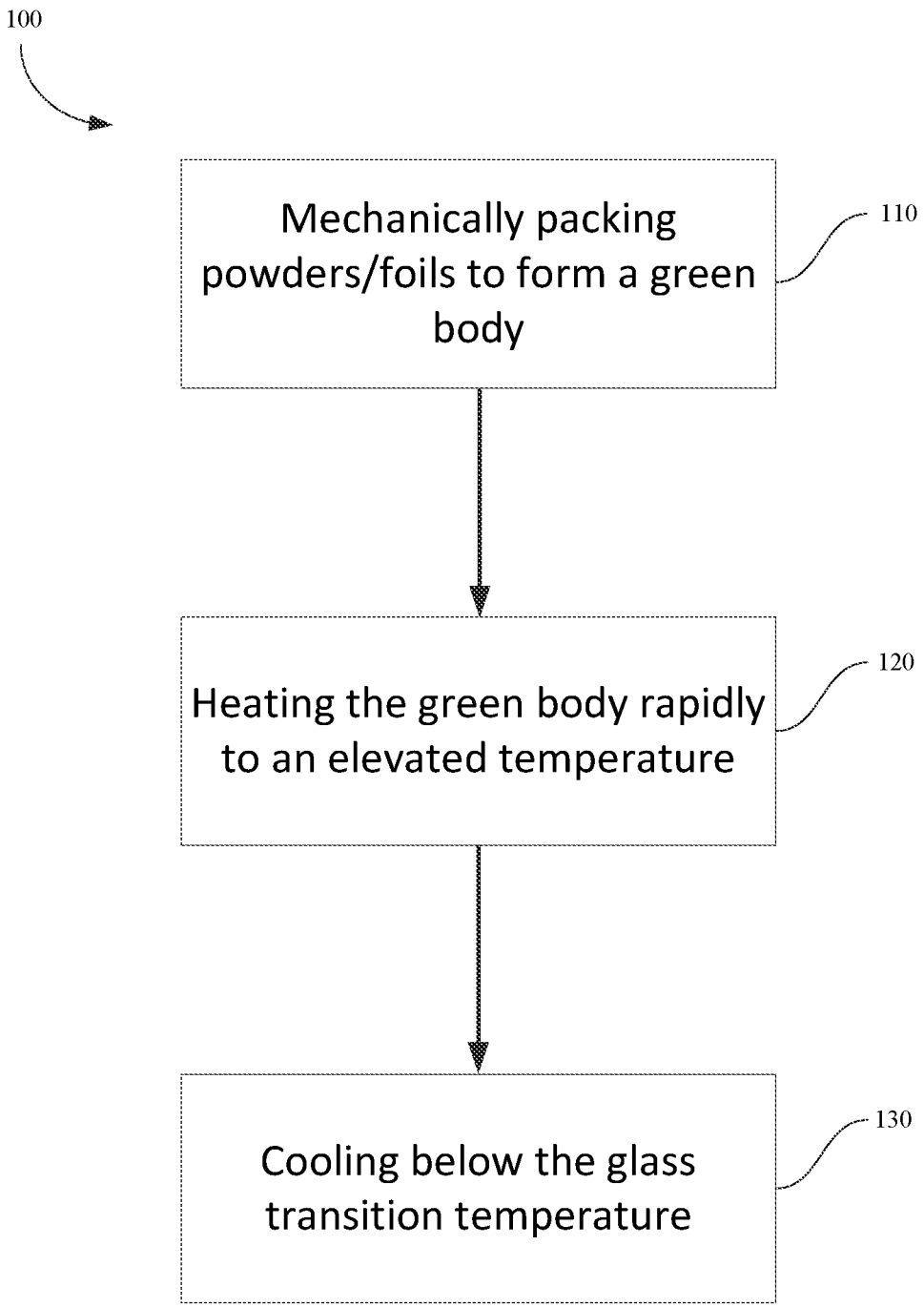
FIG. 2 is a flow chart illustrating steps for shaping of powder and foils into bulk metallic glasses (BMGs) in accordance with embodiments of the disclosure.

FIG. 2 depicts a flow chart illustrating the steps of method 100 in accordance with embodiments of the disclosure is presented. Method 100 includes a step 110 of mechanically packing the powder or foils to form a green body, a step 120 of heating the green body rapidly to a processing temperature, and a step 130 of cooling below the glass transition temperature of the metallic glass-forming alloy to form a bulk metallic glass part. The powder or foils are packed in step 110 to aid in dissipating the heat evenly and reducing localized heating in step 120. In step 120, electrical energy (e.g., 100 Joules to 100 KJoules) stored in a capacitor is discharged to heat the green body to a "process temperature" between the glass transition temperature of the metallic glass and melting point of the metallic glass-forming alloy. Once the green body is heated such that the green body has a sufficiently low process viscosity, it may be shaped into a bulk metallic glass part via any number of techniques, such as injection molding, dynamic forging, stamp forging, blow molding, etc.

In some variations, heating of the green body formed from the powder or foils can be both rapid and uniform across the powder or foil. If uniform heating is not achieved, then the sample can experience localized heating without forming a metallic glass.

In various aspects, the powder is electrically conductive. The electrical and thermal conductivities of the powder can be affected by the packing density, the particle size and/or particle distribution, the powder form (e.g. particles of a single material, particles coated with another material), and/or adding a shock wave to the green body when the energy is discharged.

To facilitate the electrical and thermal conductivities of the powder and dissipating the heat evenly, the powder or foil can be mechanically packed in a press to form a green body. Mechanical packing of the powder can reduce voids and ensure that the particles are in contact with the neighboring particles. With further reference to FIG. 2, during step 120 the green body may be shaped in a cylinder or other shapes that have a constant cross-section. In some aspects, the green body can have a constant cross-section and can be rapidly heated by using RCDF.

In some embodiments, the powder can be packed to achieve a packing density of at least 85% by weight. In some embodiments, the packing density is at least 90%. In some embodiments, the packing density is at least 95%. With high packing density, arching may be avoided during rapid heating.

In some embodiments, the electrical conductivity can also be controlled by the particle size and/particle distribution in the powder. The powder may include particles of uniform size. In other embodiments, the powder may have a bimodal distribution that includes two different particle sizes. By using two different sizes of particles, the packing density of the powder can also be increased.

In some embodiments, the electrical conductivity can also be controlled by the powder form. In some instances, the powder can comprise particles of a single material, while in other instances the powder can comprise particles coated with another material. In embodiments using powder comprising particles of a single material, the particles can be in an amorphous phase. In other embodiments, the powder can include particles coated with another material. In some instances of powder comprising particles coated with another material, the particles can be in an amorphous phase and coated with another material in an amorphous phase, while in other embodiments the particles can be crystalline and coated with another material in an amorphous phase. When the particles are in an amorphous phase, they are referred to as amorphous powder. When the particles are in a crystalline phase, they are referred to as nanocrystal powders.

Amorphous Powder

In some variations, the powder can have particles with a consistent chemical composition. For example, the particles in the powder can all have the same metallic glass forming alloy.

Figure 3:
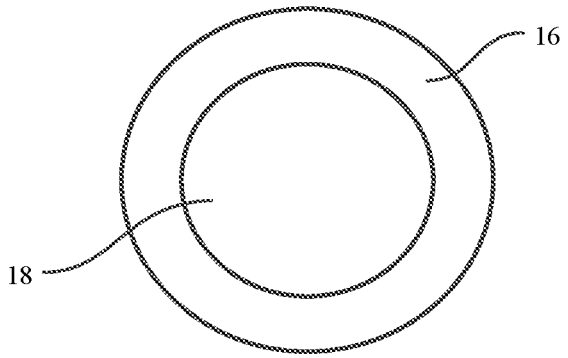
FIG. 3 shows a schematic illustration of an amorphous particle coated with a conductive material to form BMGs in an embodiment of the disclosure.

In some embodiments, the amorphous powder can include particles coated with a conductive material which has a composition different than the amorphous particles. The conductive coating helps increase the electrical conductivity of the amorphous powder. In some embodiments, the conductive coating may have better electrical conductivity and thermal conductivity than the particles, which may help rapid heating. For example, the conductive material may be copper or aluminum, which has a better electrical conductivity than the particles. FIG. 3 shows a schematic illustration of an amorphous particle coated with a conductive material to consolidate the powder and foils to form BMGs, in an embodiment of the disclosure. As shown, particle 18 includes a uniform conductive coating 16. In such embodiments, the particle 18 and the conductive coating 16 are both in an amorphous phase.

Nanocrystal Powder

In some embodiments, the powder can be a nanocrystal powder. The nanocrystal powder can include particles coated with an amorphous material (referred to as "amorphous coating").

In some embodiments, the nanocrystals may be formed of a ceramic material. In some embodiments, the composition of the coating material may also be the same as the nanocrystals, but the coating is in an amorphous phase which is different from the nanocrystals, which are in a crystalline phase. In some embodiments, the amorphous coating may have a different composition than that of the nanocrystals, which may improve the electrical conductivity of the nanocrystal particles. The amorphous coating may be formed of metallic glass-forming alloys, which have a negative slope between resistivity versus temperature. Specifically, the metallic glass-forming alloys have a relative change of resistivity per unit of temperature change of no greater than $1\times10^{-4}$° C.$^{-1}$, they enhance the conductivity of the nanocrystal powder.

In some embodiments, the amorphous coating may be formed of an amorphous metal, including Cu-based, Al-based, Pt-based, Pd-based, Au-based, Ag-based, Ni-based, Fe-based, Co-based, Mg-based, Ti-based, and Zr-based amorphous metals, among others. The metallic glass contains at least 50% by volume in an amorphous phase.

In other embodiments, the amorphous coating may also be formed of a semiconductor, such as amorphous silicon, which has a negative temperature coefficient of resistivity. Specifically, the semiconductor has a relative change of resistivity per unit of temperature change of no greater than $1\times10^{-4}$° C.$^{-}$.

In some embodiments, the amorphous coating is thermally stable at elevated temperatures such as 1000° C., among others. In other embodiments, the amorphous coating is thermally stable at temperatures of at least 1100° C., while in yet other at temperatures of at least 1200° C.

The amorphous coating may be applied to the nanocrystal particles by various conventional methods, for example, vacuum deposition including sputtering, physical vapor deposition, chemical vapor deposition, or electroplating, among others.

In some embodiments, the nanocrystal powder may be formed of a magnetic material, including Fe, Ni, Co, or a combination of thereof. The magnetic material may have a desired coercivity. The coercivity, also called the magnetic coercivity, coercive field, or coercive force, is a measure of the ability of a ferromagnetic material to withstand an external magnetic field without becoming demagnetized. The soft magnetic composite material may be used for choke coils or interactive change techniques.

For powder made of a soft magnetic material, the uniformity of the size of the nanocrystals can affect the coercive force. In some embodiments, the nanocrystals may have size of at most 50 nm. In some embodiments, the nanocrystals may have size of below 40 nm. In some embodiments, the nanocrystals may have size of below 30 nm. In some embodiments, the nanocrystals may have size of below 20 nm.

Figure 4:
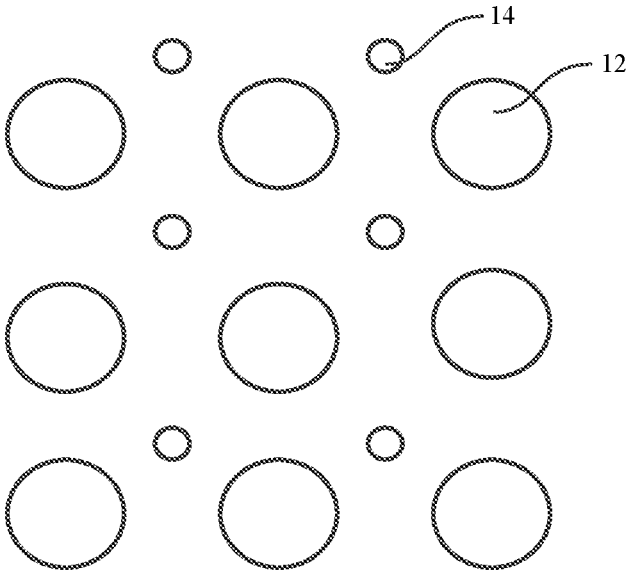
FIG. 4 shows a schematic illustration of a nanocrystal powder including bimodal sized nanocrystal particles in an embodiment of the disclosure.

In some embodiments, the electrical conductivity of the nanocrystal powder can be enhanced by controlling the particle size distribution. For example, the nanocrystal powder may include at least two different particle sizes, for example, a uniformly large size and a uniformly small size. By using two different sizes of nanocrystal particles, the packing density of the powder can also be further increased. FIG. 4 shows a schematic illustration of a nanocrystal powder including bimodal sized nanocrystal particles, in an embodiment of the disclosure. As shown in FIG. 4, smaller nanocrystal particles 14 are arranged between larger nanocrystal particles 12 filling the space between the larger nanocrystal particles.

When using a nanocrystal powder with nanocrystal particles coated with an amorphous material, the methods of the disclosure can also be used to form a bulk amorphous metal part that is a composite (i.e. a part having both a crystalline phase and an amorphous phase). In embodiments forming a bulk metallic glass part that is a composite, the composite part can be formed to have designed physical and mechanical properties which can be enhanced in comparison to the bulk metallic glasses. Generally, additional elements, such as P, B, Si, and/or C, among others, may be included in a metallic glass to help the glass-forming ability for a metallic glass to obtain bulk glass-formers or marginal glass-formers. When the glass-forming ability is improved, other properties, such as magnetic coercivity, may be impacted. In contrast, for the composite parts, the properties of the crystalline phase can be retained as well as the properties of the amorphous phase. For example, the nanocrystal particles can retain their crystal structure, thereby retaining the magnetic property during rapid heating and thus provide better magnetic properties than the metallic glass. In some embodiments, the composite part may have both the desired magnetic coercivity and high toughness. For instance, the composite part an include nanocrystals which have the desired magnetic coercivity while the amorphous phase which has a high toughness. As such, the composite part can have both the desired coercivity and high toughness.

In some aspects, the powder can be a combination of any type of powder disclosed herein. The powder can include amorphous powder, a nanocrystalline powder, or a combination thereof. The powder can be an amorphous composite that includes a mixture of crystalline particles and particles that have both crystalline and amorphous phases. The powder can also include amorphous particles covered with crystalline material.

Figure 5:
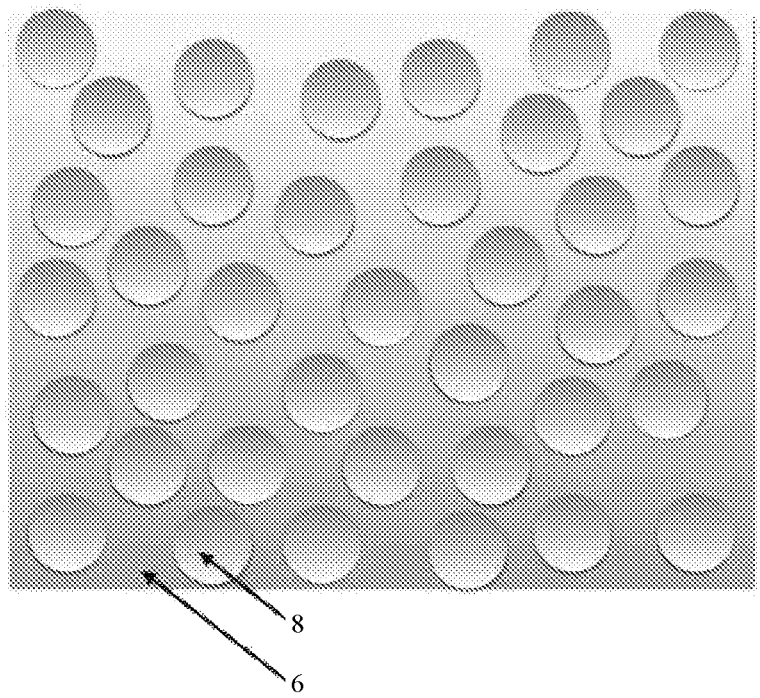
FIG. 5 shows a schematic illustration of a composite material including single sized nanocrystal particles embedded in an amorphous material in an embodiment of the disclosure.

The composite part can be formed by rapid heating, such as RCDF heating. Heating by the RCDF technique is very fast, for example, the packed nanocrystal particles or green body can be heated up to 1000° C. in about 10 ms, which is a heating rate of on the order of $10^5$ k/s. Because of the very fast heating rate, the nanocrystals may remain in a crystalline phase and can retain their magnetic properties, such as the desired magnetic coercivity. As an example, FIG. 5 shows a schematic illustration of a composite part including a crystalline phase embedded in an amorphous matrix. As shown in FIG. 5, the amorphous phase 6 acts as a matrix and surrounds the crystalline phase 8. In some embodiments, the composite material or article includes a crystalline phase formed of nanocrystals embedded in a matrix of an amorphous phase formed of an amorphous material that can have a different composition from the nanocrystals. The nanocrystals can have grain boundaries surrounded by the amorphous phase of a different material.

Amorphous Foils

In some embodiments, amorphous metal foils can be used to form the bulk metallic glass parts. In accordance with embodiments of the disclosure, the amorphous foils can be shaped into a bulk amorphous metal part. In some embodiments, amorphous foils can be used to form a green body and heated by a rapid heating technique such as RCDF, technique, microwave heating technique, pulse Joule heating technique, and the like.

Amorphous foils can be easily formed from a metallic glass-forming alloy. For example, the amorphous foil can be formed by melt spinning the metallic glass-forming alloy and fast cooling at a cooling rate of up to $10^5$ K/s. The amorphous foils are available from various suppliers and are at relatively lower cost.

Figure 6:
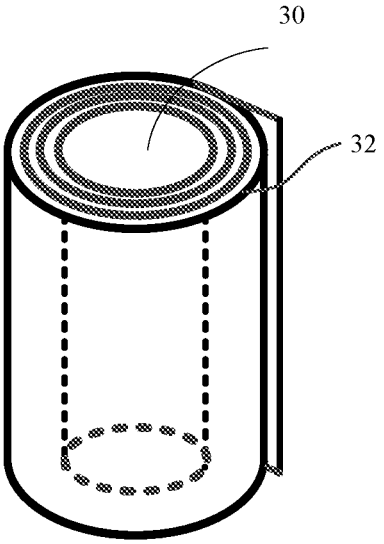
FIG. 6 shows a schematic illustration of a foil rolled into a tube to form BMGs in an embodiment of the disclosure.

Like the powder, the amorphous foils can be electrically conductive such that the heat can be dissipated evenly. As such, the foils may be mechanically packed to form a multilayer green body. By packing the foil, each of the layers of the amorphous foil is in contact with the neighboring layers. The foils may be packed by rolling as illustrated in FIG. 6. FIG. 6 shows a schematic illustration of an amorphous foil rolled into a tube in an embodiment of the disclosure. As shown, the amorphous foil 32 is rolled into a tube with hollow center 30. In other embodiments, the foils may be packed by stacking the layers and applying pressure such that each of the layers of the amorphous foil is in contact with the neighboring layers. Other methods of stacking the foil are possible.

In some embodiments, the layers of the amorphous foil have a thickness greater than 10 μm. In some embodiments, the layers of the amorphous foil have a thickness greater than 50 μm. In some embodiments, the layers of the amorphous foil have a thickness greater than 100 μm. In some embodiments, the layers of the amorphous foil have a thickness greater than 200 μm. In some embodiments, the layers of the amorphous foil have a thickness greater than 300 μm. In some embodiments, the layers of the amorphous foil have a thickness greater than 400 μm. In some embodiments, the layers of the amorphous foil have a thickness greater than 500 μm. In some embodiments, the layers of the amorphous foil have a thickness greater than 600 μm. In some embodiments, the layers of the amorphous foil have a thickness greater than 700 μm. In some embodiments, the layers of the amorphous foil have a thickness greater than 800 μm. In some embodiments, the layers of the amorphous foil have a thickness greater than 900 μm. In some embodiments, the layers of the amorphous foil have a thickness less than 1 mm. In some embodiments, the layers of the amorphous foil have a thickness less than 900 μm. In some embodiments, the layers of the amorphous foil have a thickness less than 800 μm. In some embodiments, the layers of the amorphous foil have a thickness less than 700 μm. In some embodiments, the layers of the amorphous foil have a thickness less than 600 μm. In some embodiments, the layers of the amorphous foil have a thickness less than 500 μm. In some embodiments, the layers of the amorphous foil have a thickness less than 400 μm. In some embodiments, the layers of the amorphous foil have a thickness less than 300 μm. In some embodiments, the layers of the amorphous foil have a thickness less than 200 μm. In some embodiments, the layers of the amorphous foil have a thickness less than 100 μm. In some embodiments, the layers of the amorphous foil have a thickness less than 50 μm.

Figure 7:
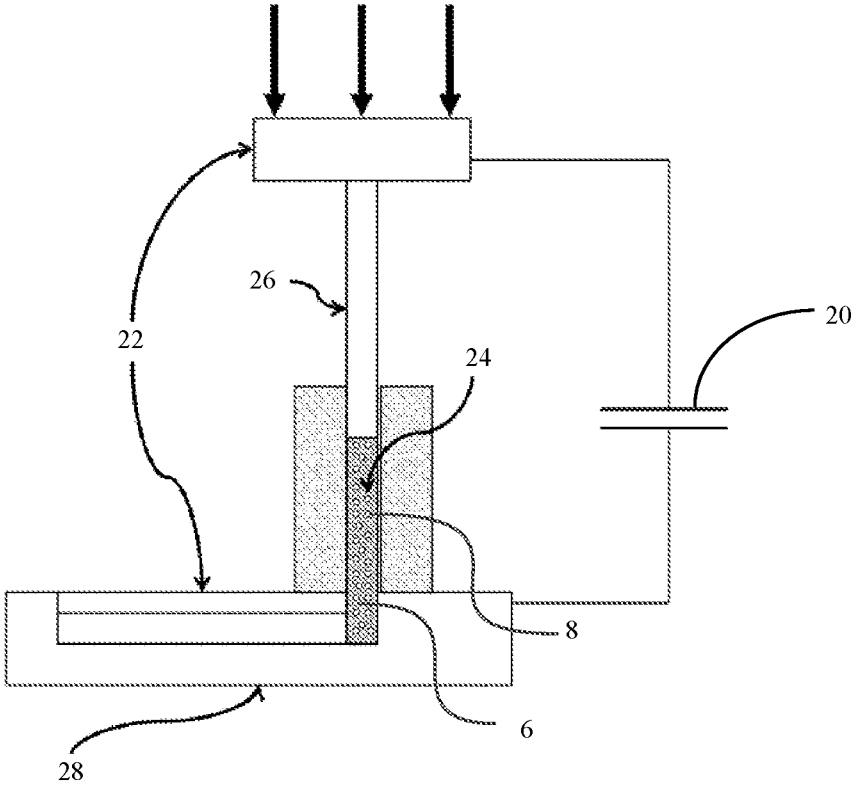
FIG. 7 illustrates a schematic of a rapid capacitor discharge forming device in an embodiment of the disclosure.

In a particular embodiment, a method includes rolling the amorphous foil into one of a tube shape or a rod shape and heating the rolled amorphous foil at a rate of $10^5$ k/s by a rapid heating technique to a temperature between the glass transition temperature and the melting point of the amorphous foil. The rolled amorphous foil forms a green body that may be placed between two electrodes or two conductive plates, as shown in FIG. 7, for rapid heating. Green bodies formed of amorphous foils can conduct electrical current uniformly between the two electrodes and be rapidly, and cooled to form a shaped article. The method also includes cooling the heated foil(s) to below the glass transition temperature to form a bulk amorphous article.

In some aspects, the green body can be formed by either packing the powder or foil, or can be formed by extrusion of the powder or foil to form a monolithic green body. The monolithic green body can be in the form of a rod or other shape. The monolithic green body can have lower density than a rod without such extrusion. For example, the monolithic green body can include voids. In various embodiments, the monolithic green body can have 80% density of a fully dense monolithic green body. In various embodiments, the monolithic green body can have 85% density of a fully dense monolithic green body. In various embodiments, the monolithic green body can have 80% density of a fully dense monolithic green body. In various embodiments, the monolithic green body can have 80% density of a fully dense monolithic green body. In various aspects, the green body can be crystalline, amorphous, or a combination of amorphous and crystalline.

RCDF Heating

When RCDF is used for rapid heating of the powder or foils, the packed powder or foil must include a continuous conductive material between two electrodes to avoid arcing during RCDF. The packed powder or foil can then be shaped into a bulk metallic glass part. As described above, in some embodiments the bulk metal part may be a composite that include a crystalline phase and an amorphous.

RCDF is disclosed in patents, including U.S. Pat. No. 8,613,813, entitled "Forming of Metallic glass by Rapid Capacitor Discharge;" U.S. Pat. No. 8,613,814, entitled "Forming of Metallic Glass by Rapid Capacitor Discharge Forging;" U.S. Pat. No. 8,613,815, entitled "Sheet Forming of Metallic Glass by Rapid Capacitor Discharge;" and U.S. Pat. No. 8,613,816, entitled "Forming of Ferromagnetic Metallic Glass by Rapid Capacitor Discharge," each of which is incorporated by reference in its entirety.

The RCDF process begins with the discharge of electrical energy (e.g., 100 Joules to 100 KJoules) stored in a capacitor into a monolithic charge of metallic glass alloy. The application of the electrical energy rapidly heats the green body to a "process temperature" above the glass transition temperature of the alloy and below the equilibrium melting point of the alloy. In some instances, the processing temperature can be half-way between the glass transition temperature of the amorphous material and the equilibrium melting point of the alloy (e.g., about 200-300 K above Tg), on a time scale of several microseconds to several milliseconds or less. The heated green body can have a viscosity sufficient to allow facile shaping (about 1 to $10^4$ Pas-s or less). If uniform heating is not achieved, then the sample can instead experience localized heating without forming a metallic glass. Likewise, if the monolithic charge heating is not sufficiently rapid (e.g., on the order of 500-$10^4$ K/s), then either the material formed can lose its amorphous character, or the shaping technique can be limited to amorphous materials having superior processability characteristics (i.e., high stability of the supercooled liquid against crystallization).

Turning to the shaping method, a schematic of an exemplary shaping tool for the RCDF method is provided in FIG. 7. As shown, a shaping tool includes a source of electrical energy 20 (capacitor) and two electrodes 22. The electrodes 22 are used to apply a electrical energy to a sample block 24, e.g. a green body. The green body can have a relative change of resistivity per unit of temperature change coefficient value S sufficiently low and a large resistivity value sufficiently high to ensure uniform heating. The electrical energy can be used to uniformly heat the sample to a predetermined "process temperature" above the glass transition temperature of the alloy in a time scale of several milliseconds or less. The viscous liquid thus formed is simultaneously shaped in accordance with a preferred shaping method, including, for example, injection molding, dynamic forging, stamp forging blow molding, among others, to form an article on a time scale of less than one second.

Any source of electrical energy suitable for supplying sufficient energy to heat the sample block to the process temperature as described herein. For example, a capacitor having a discharge time constant of from 10 μs to 10 milliseconds may be used. In addition, any electrodes suitable for providing uniform contact across the green body may be used to transmit the electrical energy. As discussed, in one embodiment, the electrodes are formed of a soft metal, such as, for example, Ni, Ag, Cu, or alloys made using at least 95 at % of Ni, Ag and Cu, and are held against the sample block under a pressure sufficient to plastically deform the contact surface of the electrode at the electrode/sample interface to conform it to the microscopic features of the contact surface of the sample block.

An injection molding apparatus may also be incorporated with the method. In such an embodiment, the viscous liquid of the heated amorphous material is injected into a mold cavity 28 (as shown in FIG. 7) held at ambient temperature using a mechanically loaded plunger to form a net shape component of the metallic glass.

In some embodiments, the method can include a step of mechanically packing the powder to form a green body (as described above). The green body can be heated, e.g. at a rate of $10^5$ K/s, by a rapid heating technique to a temperature between the glass transition temperature and the melting point of the amorphous material in the green body. A bulk metallic glass part is formed by cooling the heated green body to be below the glass transition temperature of the amorphous material. In some embodiments, the shaped bulk amorphous part may be shaped in a rod, a tube, a plate or any other shapes.

In some embodiments, the shaped bulk metallic glass part may be a composite including an amorphous phase and a crystalline phase. The composite part may include at least 50% by volume the amorphous phase and the remaining balance of the volume in a crystalline phase. In some embodiments, the composite part may include at least 60% by volume the amorphous phase. In some embodiments, the composite part may include at least 70% by volume the amorphous phase. In some embodiments, the composite part may include at least 80% by volume the amorphous phase. In some embodiments, the composite material may include at least 90% by volume the amorphous phase. In some embodiments, the composite material may include at least 95% by volume the amorphous phase. In some embodiments, the crystalline phase can provide higher coercivity for the composite part.

The powder or foil can include any suitable metallic glass-forming alloy known in the art. In some non-limiting aspects, the metallic glass-forming alloy can be based on, or alternatively include, one or more elements that oxidize, such as Zr, Ti, Ta, Hf, Mo, W and Nb. In some variations, the metallic glass-forming alloy includes at least about 30% one or more of Zr, Ti, Ta, Hf, Mo, W and Nb. In some variations, the metallic glass-forming alloy includes at least about 40% one or more of Zr, Ti, Ta, Hf, Mo, W and Nb. In some variations, the metallic glass-forming alloy includes at least about 50% one or more of Zr, Ti, Ta, Hf, Mo, W and Nb. In certain embodiments, the metallic glass-forming alloy can be based on, or alternatively include, Zr. In some variations, the metallic glass-forming alloy includes at least about 30% Zr. In some variations, the metallic glass-forming alloy includes at least about 40% Zr. In some variations, the metallic glass-forming alloy includes at least about 50% Zr. In some aspects, the alloy is a marginal glass forming alloy.

The metallic glass-forming alloy can include multiple transition metal elements, such as at least two, at least three, at least four, or more, transitional metal elements. The metallic glass-forming alloy can also optionally include one or more nonmetal elements, such as one, at least two, at least three, at least four, or more, nonmetal elements. A transition metal element can be any of scandium, titanium, vanadium, chromium, manganese, iron, cobalt, nickel, copper, zinc, yttrium, zirconium, niobium, molybdenum, technetium, ruthenium, rhodium, palladium, silver, cadmium, hafnium, tantalum, tungsten, rhenium, osmium, iridium, platinum, gold, mercury, rutherfordium, dubnium, seaborgium, bohrium, hassium, meitnerium, ununnilium, unununium, and ununbium. In one embodiment, a metallic glass containing a transition metal element can have at least one of Sc, Y, La, Al, Ti, Zr, Hf, V, Nb, Ta, Cr, Mo, W, Mn, Tc, Re, Fe, Ru, Os, Co, Rh, Ir, Ni, Pd, Pt, Cu, Ag, Au, Zn, Cd, and Hg. Depending on the application, any suitable transitional metal elements, or their combinations, can be used.

In some embodiments, the metallic glass-forming alloy described herein can be fully alloyed. The term fully alloyed used herein can account for minor variations within the error tolerance. For example, it can refer to at least 90% alloyed, such as at least 95% alloyed, such as at least 99% alloyed, such as at least 99.5% alloyed, or such as at least 99.9% alloyed. The percentage herein can refer to either volume percent or weight percentage, depending on the context. These percentages can be balanced by impurities, which can be in terms of composition or phases that are not a part of the alloy. The alloys can be homogeneous or heterogeneous, e.g., in composition, distribution of elements, amorphicity/crystallinity, etc.

The metallic glass-forming alloy can include any combination of the above elements in its chemical formula or chemical composition. The elements can be present at different weight or volume percentages. Alternatively, in one embodiment, the above-described percentages can be volume percentages, instead of weight percentages.

In certain embodiments, the metallic glass-forming alloy can be zirconium-based. The metallic glass-forming alloy can also be substantially free of various elements to suit a particular purpose. For example, in some embodiments, the metallic glass can be substantially free of nickel, aluminum, titanium, beryllium, or combinations thereof. In one embodiment, the alloy or the composite is completely free of nickel, aluminum, titanium, beryllium, or combinations thereof.

The described metallic glass-forming alloy can further include additional elements, such as additional transition metal elements, including Nb, Cr, V, and Co. The additional elements can be present at less than or equal to about 30 wt. %, less than or equal to about 20 wt. %, less than or equal to about 10 wt. %, or less than or equal to about 5 wt. %. In one embodiment, the additional, optional element is at least one of cobalt, manganese, zirconium, tantalum, niobium, tungsten, yttrium, titanium, vanadium and hafnium to form carbides and further improve wear and corrosion resistance. Further optional elements can include phosphorous, germanium and arsenic, totaling up to about 2%, or less than 1%, to reduce the melting point. Otherwise incidental impurities should be less than about 2% or less than 0.5%.

In some embodiments, the metallic glass-forming alloy can include a small amount of impurities. The impurity elements can be intentionally added to modify the properties of the composition, such as improving the mechanical properties (e.g., hardness, strength, fracture mechanism, etc.) and/or improving the corrosion resistance. Alternatively, the impurities can be present as inevitable, incidental impurities, such as those obtained as a byproduct of processing and manufacturing. The impurities can be less than or equal to about 10 wt. %, about 5 wt. %, about 2 wt. %, about 1 wt. %, about 0.5 wt. %, or about 0.1 wt. %. In some embodiments, these percentages can be volume percentages instead of weight percentages.

The disclosed methods herein can be valuable in the fabrication of electronic devices using a metallic glass-containing part. An electronic device herein can refer to any electronic device known in the art. For example, it can be a telephone, such as a mobile phone, and a land-line phone, or any communication device, such as a smart phone, including, for example an iPhone®, and an electronic email sending/receiving device. It can be a part of a display, such as a digital display, a TV monitor, an electronic-book reader, a portable web-browser (e.g., iPad®), and a computer monitor. It can also be an entertainment device, including a portable DVD player, conventional DVD player, Blue-Ray disk player, video game console, music player, such as a portable music player (e.g., iPod®), or wearable device (e.g., AppleWatch®), etc. It can also be a part of a device that provides control, such as controlling the streaming of images, videos, sounds (e.g., Apple TV®), or it can be a remote control for an electronic device. It can be a part of a computer or its accessories, such as the hard drive tower housing or casing, laptop housing, laptop keyboard, laptop track pad, desktop keyboard, mouse, and speaker. The article can also be applied to a device such as a watch or a clock.

The methods can also be valuable in forming wearable metallic glass products that have a good cosmetic profile and do not readily degrade or show evidence of wear.

EXAMPLE

A compressed sample rod was formed from a $Zr_{65}Cu_{18}Ni_7Al_{10}$ powder, as disclosed earlier by steps as shown in FIG. 2. The powder included amorphous particles, crystalline particles, and particles with both amorphous and crystalline character. The compressed sample rod included crystalline and amorphous portions. The compressed sample rod included voids on the micron scale.

The compressed sample rod was placed in an RCDF instrument and rapidly heated, then injected into a small plate mold to form an article or an object. The molded article or object was detected to be amorphous. As such, a metallic glass object can be formed from amorphous particles, crystalline particles, and a combination of amorphous and crystalline particles.

Figure 8:
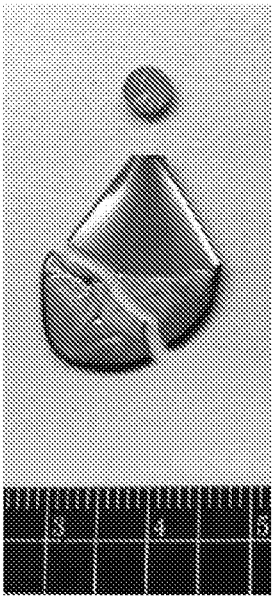
FIG. 8 is an optical image of a cracked molded part by using an input energy of 2600 J/cm$^3$ for RCDF.

In a particular example, a $Zr_{65}Cu_{18}Ni_7Al_{10}$ powder was not fully amorphous, and included a mixture of nano crystals and amorphous particles. The molded articles were formed under various processing conditions including input energy for the RCDF instrument. Experiments revealed that an excessive energy of 2600 J/cm$^3$ yielded part that had cracks, as shown in FIG. 8. The part included a coarse crystallized portion. Without wishing to be limited to a particular mechanism or mode of action, the embrittlement of the part may be caused by the coarse crystallized portion.

Figure 9:
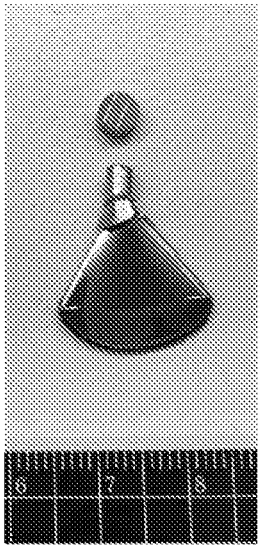
FIG. 9 is an optical image of a non-cracked molded part by using an input energy of 2400 J/cm$^3$ for RCDF.

In contrast, a lower energy of 2400 J/cm$^3$ yielded a part that does not have cracks, as shown in FIG. 9. In some variations, this part may be fully amorphous or may not include the coarse crystallized portion.

Any ranges cited herein are inclusive. The terms "substantially" and "about" used throughout this Specification are used to describe and account for small fluctuations. For example, they can refer to less than or equal to ±5%, such as less than or equal to ±2%, such as less than or equal to ±1%, such as less than or equal to ±0.5%, such as less than or equal to ±0.2%, such as less than or equal to ±0.1%, such as less than or equal to ±0.05%.

Having described several embodiments, it will be recognized by those skilled in the art that various modifications, alternative constructions, and equivalents may be used without departing from the spirit of the invention. Additionally, a number of well-known processes and elements have not been described in order to avoid unnecessarily obscuring the present invention. Accordingly, the above description should not be taken as limiting the scope of the invention.

Those skilled in the art will appreciate that the presently disclosed embodiments teach by way of example and not by limitation. Therefore, the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall therebetween.

What is claimed is:

1. A method of forming a bulk metallic glass from a metallic glass-forming alloy comprising:

packing a metallic glass-forming alloy powder to form a green body;

heating the green body to a temperature between the glass transition temperature and the melting point of the metallic glass-forming alloy to form a heated green body; and cooling the heated green body to a temperature below the glass transition temperature of the metallic glass-forming alloy to form the bulk metallic glass.

2. The method of claim 1, wherein the metallic glass-forming alloy powder comprises amorphous particles.

3. The method of claim 1, wherein the metallic glass-forming alloy powder comprises nanocrystals coated with an amorphous material.

4. The method of claim 3, wherein the amorphous material has a different chemical composition than the nanocrystals.

5. The method of claim 1, wherein the step of heating the green body is at a rate at least $1\times10^5$ K/s.

6. The method of claim 1, wherein the metallic glass-forming alloy comprises one of a metallic glass selected from a group consisting of Cu-based, Al-based, Pt-based, Pd-based, Au-based, Ag-based, Ni-based, Fe-based, Co-based, Mg-based, Ti-based, and Zr-based metallic glass-forming alloys.

7. The method of claim 3, wherein the amorphous material is a semiconductor.

8. The method of claim 7, wherein the semiconductor comprises silicon.

9. The method of claim 3, wherein each nanocrystal is smaller than 20 nm.

10. The method of claim 3, wherein each nanocrystal is a single size.

11. The method of claim 1, wherein the powder comprises particles having a bimodal size distribution.

12. The method of claim 1, wherein the green body has a packing density of at least 70% by volume.

13. The method of claim 1, further comprising heating the green body by one of RCDF, microwave heating, and pulse Joule heating.

14. The method of claim 3, wherein the nanocrystals comprise at least one of Fe-based oxides, Ni-based oxides, Co-based oxides, or ceramic.

15. The method of claim 3, wherein the nanocrystals are uniformly distributed in the bulk metallic glass.

16. A method of forming a metallic glass from a metallic glass-forming alloy, comprising:

packing one or more layers of an amorphous foil to form a green body;

heating the green body to a temperature between the glass transition temperature and the melting point of the metallic glass-forming alloy; and cooling the heated green body to a temperature below the glass transition temperature to forming a bulk metallic glass.

17. The method of claim 16, wherein the step of heating is at a rate of at least $10^5$ K/s.

18. The method of claim 17, wherein the step of packing comprises rolling the one or more layers of the amorphous foil.

19. The method of claim 18, wherein the step of packing comprises:

stacking the layers of amorphous foil, and applying pressure to the stacked layers of amorphous foil.

20. The method of claim 16, wherein each layer has a thickness ranging from 10 μm to 1 mm.

* * * * *